United States Patent [19]

Eberhardt

[11] Patent Number: 4,786,239

[45] Date of Patent: Nov. 22, 1988

[54] PUMPING SYSTEM SELECTABLY OPERABLE AS A FIRE PUMP OR A HYDRAULIC PUMP

[75] Inventor: H. Alfred Eberhardt, Paoli, Pa.

[73] Assignee: Hale Fire Pump Company, Conshohocken, Pa.

[21] Appl. No.: 504,468

[22] Filed: Jun. 15, 1983

[51] Int. Cl.[4] ..... F04B 39/11

[52] U.S. Cl. ..... 417/238; 417/360; 417/364; 417/390

[58] Field of Search ..... 417/201, 238, 360, 369, 417/375, 390, 199 R; 169/13; 415/122 R

[56] References Cited

U.S. PATENT DOCUMENTS

| | | | |
|---|---|---|---|
| 1,916,626 | 7/1933 | McKean et al. | 417/201 |
| 1,982,841 | 12/1934 | Tamini | 417/390 X |
| 2,149,600 | 3/1939 | Guinard | 417/390 |
| 2,662,481 | 12/1953 | Grise | 417/201 |
| 2,710,579 | 6/1955 | Kriegbaum | 417/365 |
| 2,910,948 | 11/1959 | Betzen | 417/405 |
| 3,574,487 | 4/1971 | Mohn | 417/405 |
| 3,907,463 | 9/1975 | Eller et al. | 417/360 |
| 3,957,403 | 5/1976 | Sloan | 417/390 |
| 4,050,858 | 9/1977 | Ewbank et al. | 417/390 X |
| 4,272,224 | 6/1981 | Kabele | 417/364 X |

FOREIGN PATENT DOCUMENTS

| | | | |
|---|---|---|---|
| 326144 | 9/1920 | Fed. Rep. of Germany | 417/390 |
| 2452775 | 5/1976 | Fed. Rep. of Germany | 417/360 |
| 321840 | 10/1934 | Italy | 417/364 |

*Primary Examiner*—Leonard E. Smith

*Attorney, Agent, or Firm*—Frank A. Follmer

[57] ABSTRACT

A pumping system for shipboard use is comprised of a submersible centrifugal dewatering pump driven by a high pressure hydraulic motor mounted directly on the submersible pump, a hose means being connected from the hydraulic motor to a hydraulic pump located up on deck and arranged to be driven by an engine-driven standby fire pump. Quick couple-disconnect couplings are provided so that the pumping system can be operated in a dewatering mode, a fire fighting mode or a mode in which the pumping system supplies a source of power for operating various emergency power tools in holds or under water. Another pumping system has a discharge line from a fire pump arranged to drive a water motor mounted on a submersible pump for driving the same.

10 Claims, 5 Drawing Sheets

PUMPING SYSTEM SELECTABLY OPERABLE AS A FIRE PUMP OR A HYDRAULIC PUMP

BACKGROUND AND SUMMARY OF THE INVENTION

This invention relates to pumping systems of the type particularly suitable for shipboard use or use in similar applications. On naval ships there is normally available an engine-driven fire pump ready for use in case of a fire. The reliability of the fire pump for emergency use must be 100%. However, during normal conditions, the actual use of these fire pumps is for dewatering purposes. Accordingly, the typical navy fire pump is a centrifugal pump designed to be able to handle both fire fighting and dewatering operations. In some dewatering operations, the engine and fire pump must be taken down the hold, thereby requiring, for safety, the provision of an engine exhaust hose which must be run a substantial distance, the exhaust hose serving to remove the engine-produced carbon monoxide from the hold. Also, in many cases it is necessary to lift the water a substantial distance and since centrifugal pumps are limited in how high they can lift water, special equipment, such as eductors, may have to be used in high lift applications.

It is the general object of the invention to provide a pumping system of the indicated type which eliminates the necessity of taking the pump down into the hold, thereby also avoiding the carbon monoxide safety problem, and which overcomes the lift problems faced by the prior art pumping systems.

Briefly stated, the general object of the invention is achieved by providing a submersible centrifugal pump which is driven by a small compact high pressure hydraulic motor. The hydraulic motor is mounted directly onto the submersible pump so that the hydraulic motor and submersible pump can be submerged together in the hold. A hose means, including a retractable reel, is connected from the hydraulic motor to a hydraulic pump located up on deck along with the engine-driven fire pump. The hydraulic pump is arranged to be drivingly connected to the fire pump output shaft.

The pumping system of the invention can be operated in several modes. For example, in the event that there is a need for dewatering, the hydraulic pump and hydraulic motor unit is connected to be driven by the fire pump and to drive the submersible pump which is submerged at the location where the dewatering is to be achieved. A retractable reel is provided to permit locating of the submersible pump at remote locations. The submersible pump is designed to provide just enough pumping pressure to lift water over the side of the ship. Thus, the submersible pump is designed to be a high volume, low pressure type of pump while the fire pump is a low volume, high pressure type of pump particularly adapted for fire fighting applications. Thus, each pump is designed for its primary use.

In the fire fighting mode of the pumping system, the hydraulic pump is disconnected from the fire pump and the engine-pump unit operates in conventional manner for the fighting of fires or the like.

In a third mode of operation, the pumping system supplies a source of power for safely operating various emergency power tools in holds or under water, etc. With the engine being remotely operated, the exhaust gases can safely escape without danger to the crew members.

A further mode of operation of the pumping system of the invention involves the use of a separate engine drive for both the fire pump and the hydraulic pump permitting performing of both fire fighting and dewatering operations.

In addition, the pumping system of the invention can be set up so that the hydraulic pump is used to drive various types of hydraulically operated devices, such as any of the hydraulically operated tools used on ships including hydraulic ram devices, hydraulic motor driven tools like saw blades, etc.

An important advantage of the pumping system of the invention is that it can be made to be light in weight so that it is portable. The advantage results from the design whereby the hydraulic unit is quickly detachable from the engine-driven unit, i.e., the hydraulic pump and motor unit is a separate unit from the engine-drive fire pump.

In another embodiment of the invention a discharge line from the fire pump is arranged to drive a water motor which is mounted on the submersible pump for driving the same.

DETAILED DESCRIPTION OF THE PREFERRED EMBODIMENT

Figure 1:
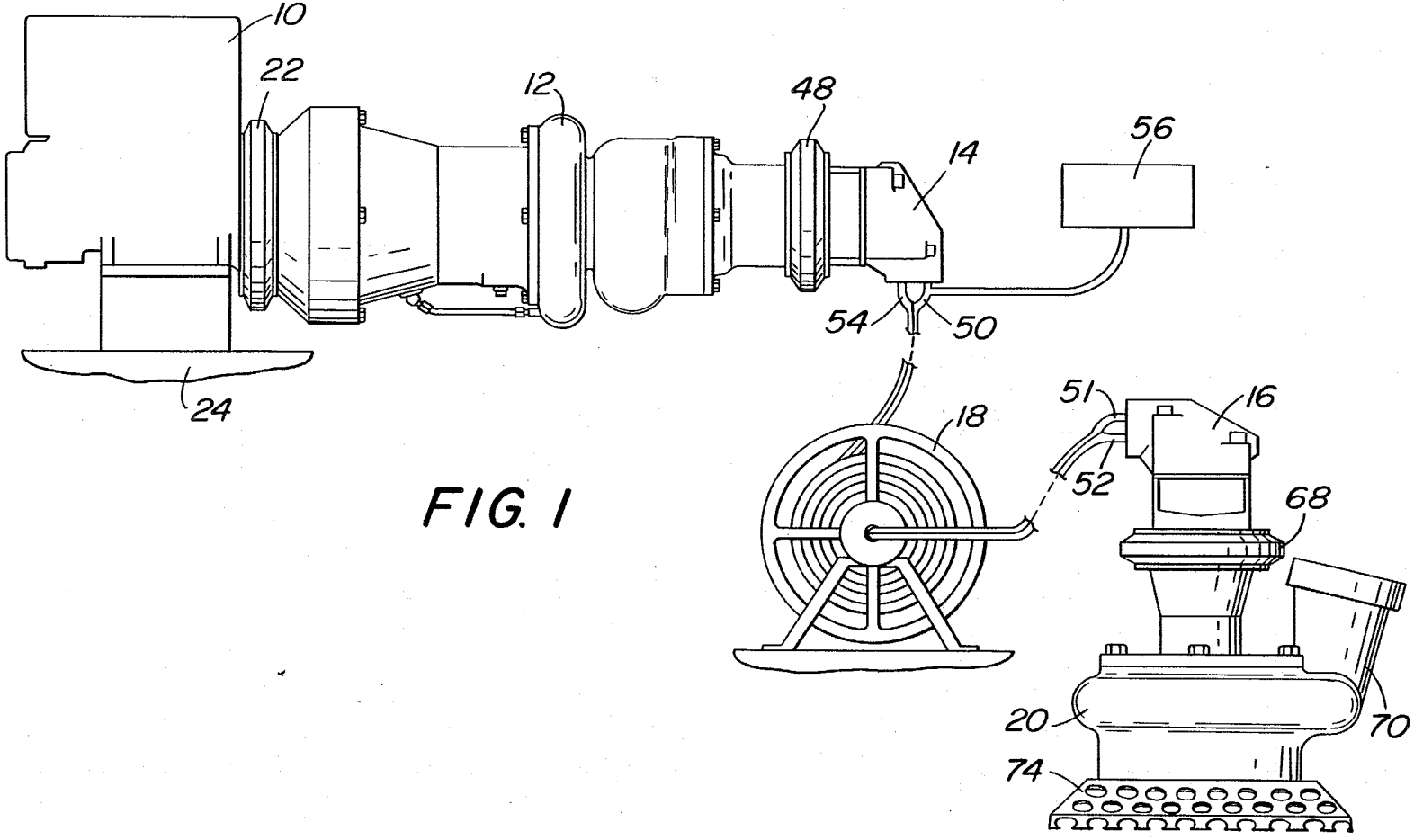
FIG. 1 is an elevational view of a pumping system in accordance with the invention.

The pumping system of the invention comprises three separate components, namely, (1) an engine 10 and a standby fire pump 12, (2) a sealed and pressurized unit including a hydraulic pump 14, a hydraulic motor 16, and hose means including a retractable reel 18, and (3) a submersible pump 20.

By way of example, engine 10 may comprise a 25 horsepower, two cylinder, air-cooled engine operating at 5000 RPM. Pump 12 is coupled to the power take-off shaft 11 of engine 10 by means of a conventional quick couple-disconnect couping comprising a releasable coupling means 21 and clamping means 22 whereby the pump drive shaft 24 can be quickly coupled and decoupled from the engine power take-off shaft 11. Engine 10 and pump 12 are supported on a portable skid or carrying frame 24 which also supports the fuel supply for engine 10.

Figure 2:
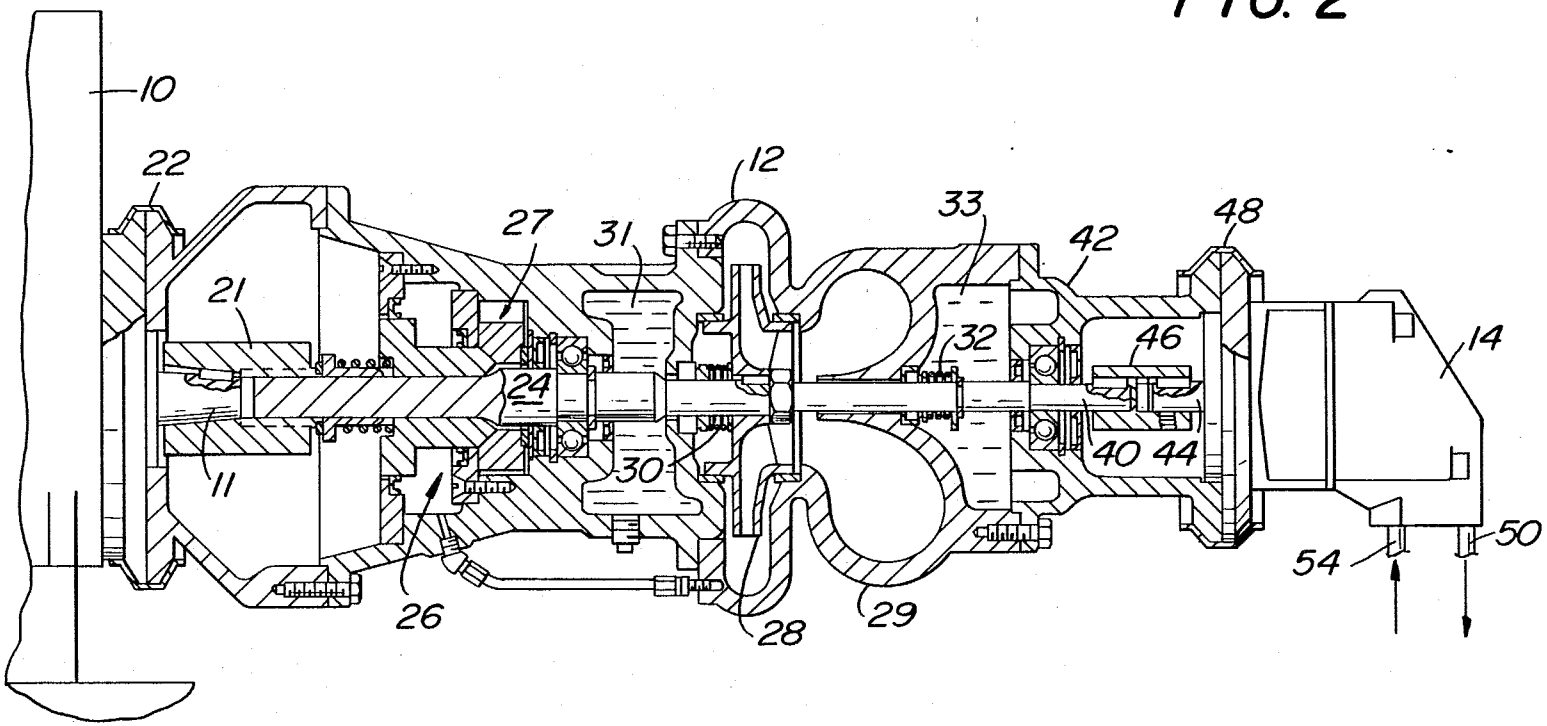
FIG. 2 is a sectional view of the engine driven fire pump in driving engagement with the hydraulic pump.

Pump 12 is a standby fire fighting pump and, by way of example, may comprise a 200 G.P.M., 150 P.S.I. centrifugal pump. For automatic priming, pump 12 is provided with a pressure responsive de-clutching means 26 to disconnect a priming pump 27 after pump 12 has been properly primed. Alternatively, a hand operated piston primer may be provided for manual priming. The impeller 28 and the volute 29 of the centrifugal pump 12 are shown in FIG. 2.

In accordance with the invention, pump 12 is provided with means whereby the pump can be run "dry".

To this end, there are provided mechanical seals 30 and 32 and lubricating liquid baths 31 and 33, respectively, surrounding said seals. The mechanical seal arrangement permits the "dry" running of pump 12 which is necessary in accordance with some modes of operation of the pumping system of the invention when pump 12 is not used for the pumping of water for fire fighting purposes and no water is supplied to the pump impeller 28.

Pump 12 has an output shaft 40 projecting from the end plate 42 thereof. Means are provided for coupling the drive shaft 44 of hydraulic pump 14 with output shaft 40 so that hydraulic pump 14 can be driven by pump 12. Such coupling means comprises a quick couple-disconnect type of coupling arrangement which is best shown in FIG. 2 and comprises a releasable coupling 46 and a clamping means 48 capable of being quickly connected and disconnected so that drive shaft 44 of hydraulic pump 14 can be placed into and out of driving engagement with output shaft 40 of pump 12 as desired.

By way of example, hydraulic pump 14 is a positive displacement hydraulic multiple piston pump rated at 10 G.P.M. at 3000 P.S.I. and operating at 5000 RPM. As was stated above, hydraulic pump 14 is part of a sealed and pressurized unit which also includes hydraulic motor 16 which, by way of example, is a positive displacement motor designed to operate at 2500 RPM.

This sealed unit comprises hose means for providing fluid flow connections between the discharge 50 of hydraulic pump 14 and the inlet 51 of hydraulic motor 16 and the outlet 52 of hydraulic motor 16 and the inlet 54 of hydraulic pump 14. As shown in FIG. 1, such hose means comprises a dual conduit hose line contained on a retractable reel 18. By way of example, the hose line is made of high pressure hydraulic hose (typically $\frac{1}{4}$ to $\frac{3}{4}$ inch ID) and the hydraulic fluid is of a type having a fairly constant viscosity, such as a silicone fluid that is also fireproof and not affected substantially by severe temperatures such as might occur in the arctic or in the tropics.

The displacement per revolution of hydraulic motor 16 is substantially more than the displacement per revolution of the pump so as to give a reduction in RPM. In the typical pump and motor described above this reduction would be two to one. In other words with hydraulic pump 14 turning at 5000 RPM, hydraulic motor 16 would only be turning at 2500 RPM in order to provide a lower pressure, which pressure is much less than the high pressure of fire pump 12. This provides the desired high torque at modest speed in order to provide a high volume, low pressure dewatering pump by the driving of submersible pump 20 as will be described hereafter. By way of example, the hydraulic fluid is delivered into motor 16 at a high pressure, such as 3000 P.S.I., and leaves the same at about 15 to 20 P.S.I. and flows back up to the suction inlet of hydraulic pump 14 whereat it might enter the same at zero P.S.I.G.

The hydraulic system is charged under moderate pressure by the use of a hydraulic accumulator 56 which is attached to the hose line at a location adjacent the discharge 50 from hydraulic pump 14. Accumulator 56 is preferably a light-weight, bladder-type hydraulic accumulator which serves to keep the entire hydraulic system charged. Hydraulic pump 14, hydraulic motor 16, reel 18 and the hydraulic hose line, and accumulator 56 which maintains pressure on the unit are all a sealed unit. Hydraulic accumulator 56 also serves to smooth out the pulsations from the pistons of hydraulic pump 14 as is well known in the art.

By way of example, submersible pump 20 is a conventional type suitable for dewatering purposes such as a centrifugal pump delivering 800 G.P.M. at 40 P.S.I. through its discharge 70. Pump 20 is provided with a conventional impeller 72 and inlet means 74.

Figure 3:
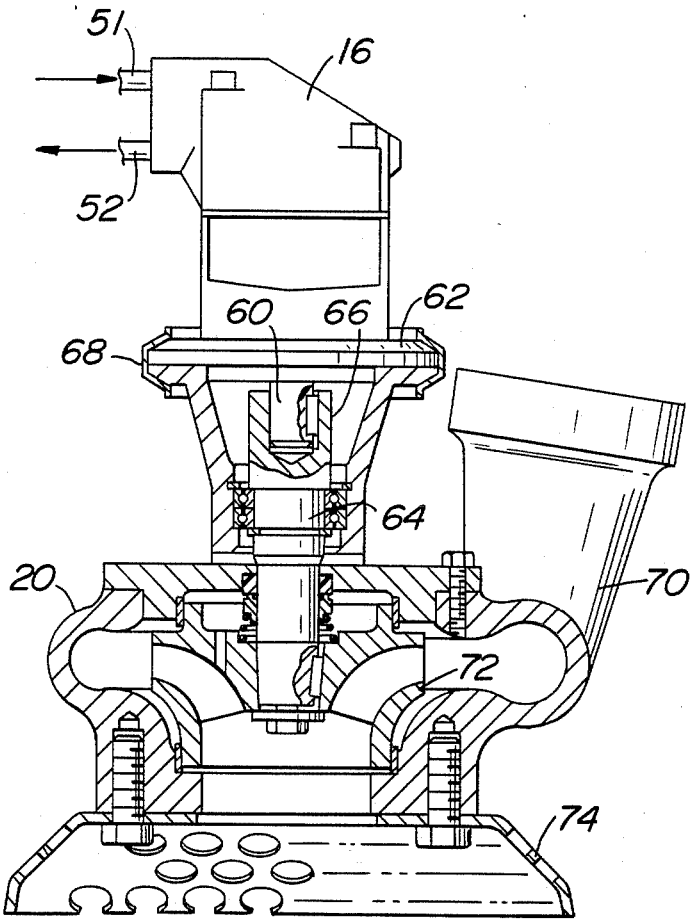
FIG. 3 is a sectional view of the submersible pump-hydraulic motor combination.

Hydraulic motor 16 has an output shaft 60 projecting from its end plate 62 as shown in FIG. 3. Means are provided for coupling the drive shaft 64 of submersible pump 20 to output shaft 60 so that submersible pump 20 can be driven by hydraulic motor 16. Such coupling means comprises a quick couple-disconnect type of coupling arrangement best shown in FIG. 3 and including a releasable coupling 66 and a clamping means 68 capable of being quickly connected and disconnected so that output shaft 60 of hydraulic motor 16 can be quickly engaged and disengaged with drive shaft 64 of submersible pump 20.

The pumping system in accordance with the invention is adapted to operate in several different modes, particularly when used on board ships. With the components of the pumping system connected as shown in FIG. 1, the pumping system can be used for performing dewatering operations at various locations remote from the engine 10 which can be located up on deck while submersible pump 20 can be located down in the hold or at any other location whereat the dewatering is to be achieved. Since a typical hydraulic hose means would be 50 to 100 feet long, submersible pump 20 can be located a substantial distance from engine 10. In this mode of use, engine 10 drives hydraulic pump 14 through fire pump 12 and hydraulic motor 16 is driven by hydraulic pump 14 and, in turn, drives submersible pump 20. The discharge 70 of the submersible pump is connected by suitable hoses to a location for discharging the water. In some shipboard applications, such as aircraft carriers, it may be necessary to raise the water as much as fifty feet. In this event, pump 20 is submerged in the water and a flexible hose is run from the discharge 70 thereof to the inlet of fire pump 12 which functions to push the water up a substantial distance, the operation involving operating the two pumps 12 and 20 in series to provide a very high lift.

Another mode of operation of the pumping system of the invention is for fire fighting applications. In this mode of operation, hydraulic pump 16 is decoupled from the output shaft 40 of fire pump 12 and the fire pump 12 operates in a conventional manner to supply water to the fire fighting equipment. By reason of the provision of the quick couple-disconnect means, the pumping system can be placed into and out of the fire fighting mode rapidly.

In another mode of operation there are provided a separate engine drive for the hydraulic pump 16 and a unit comprising engine 10 and fire pump 12 is maintained in its standby condition for fire fighting purposes. While this mode of operation is possible, advantage in the continued use of engine 10 for driving hydraulic pump 16 is that it exercises the engine 10 and maintains the readiness thereof.

It is noted that a feature of the provision of the quick couple-disconnect means at the power take-off shaft of engine 10 is that in the event of any trouble with engine 10 it would be possible to quickly replace the engine 10 for he whole pumping system.

In use on board ships, the pumping system of the invention would normally be in a standby condition ready for a fire fighting use in which case hydraulic pump 16 is not connected to be driven by fire pump 12. However, at any time when there is a need to perform salvage work or dewatering work, hydraulic pump 16 is quickly coupled to be driven by the output shaft 40 of pump 12 and the operator simply runs the reel 18 out the desired length required to permit the submerging of the high volume submersible centrifugal pump 20.

In another mode of operation, the pumping system of the invention can be set up so that the hydraulic pump is used to drive various types of hydraulically operated devices instead of the submersible pump 20. In this case, the system comprises a hydraulic pump (like pump 14) and a hose means including a reel (like reel 18) but instead of being connected to the submersible pump unit, the hose means is connected at its end to a hydraulic motor, such as hydraulic motor 16, which drives the hydraulic tool, or it is connected at its end directly to the hydraulic device. By this arrangement, the pumping system can be used to drive any of the hydraulically operated tools such as those used on ships, such as for example, hydraulic ram devices or hydraulic motor driven tools.

Figure 4:
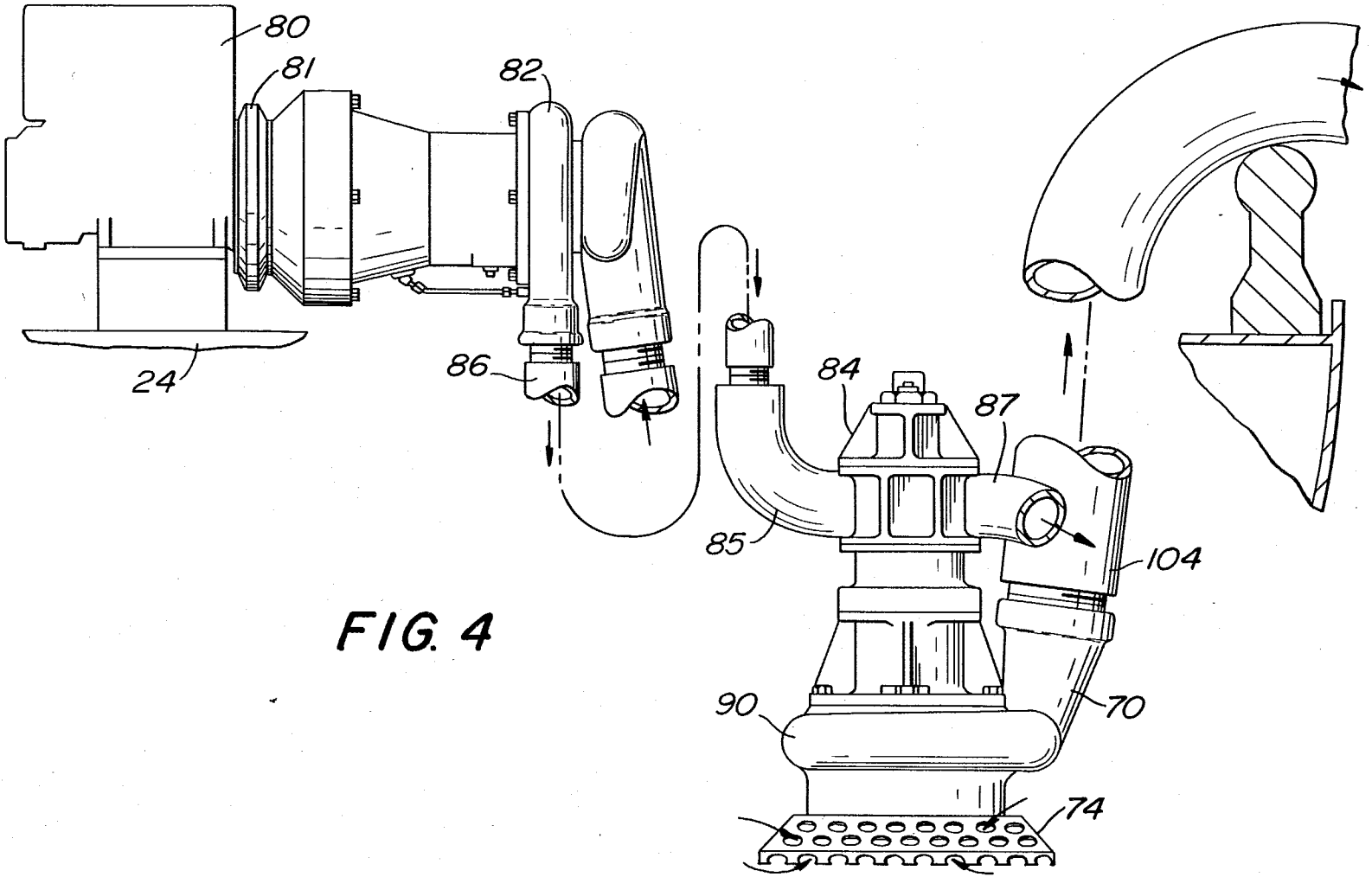
FIGS. 4 and 5 are elevational views of a pumping system in accordance with a second embodiment of the invention.
Figure 5:
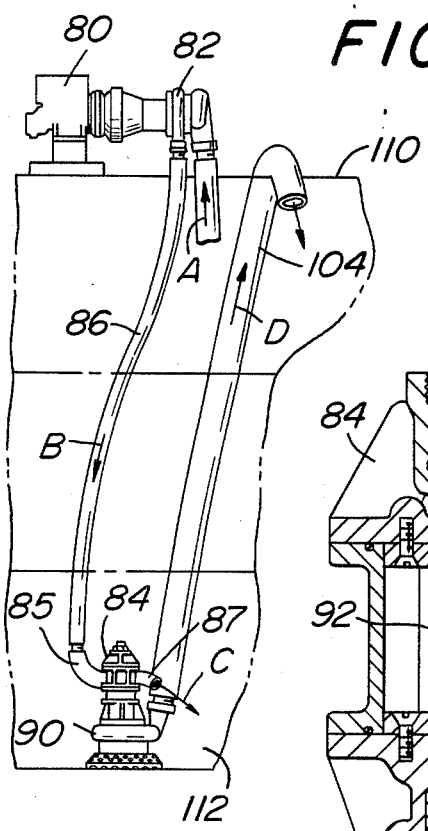
Figure 6:
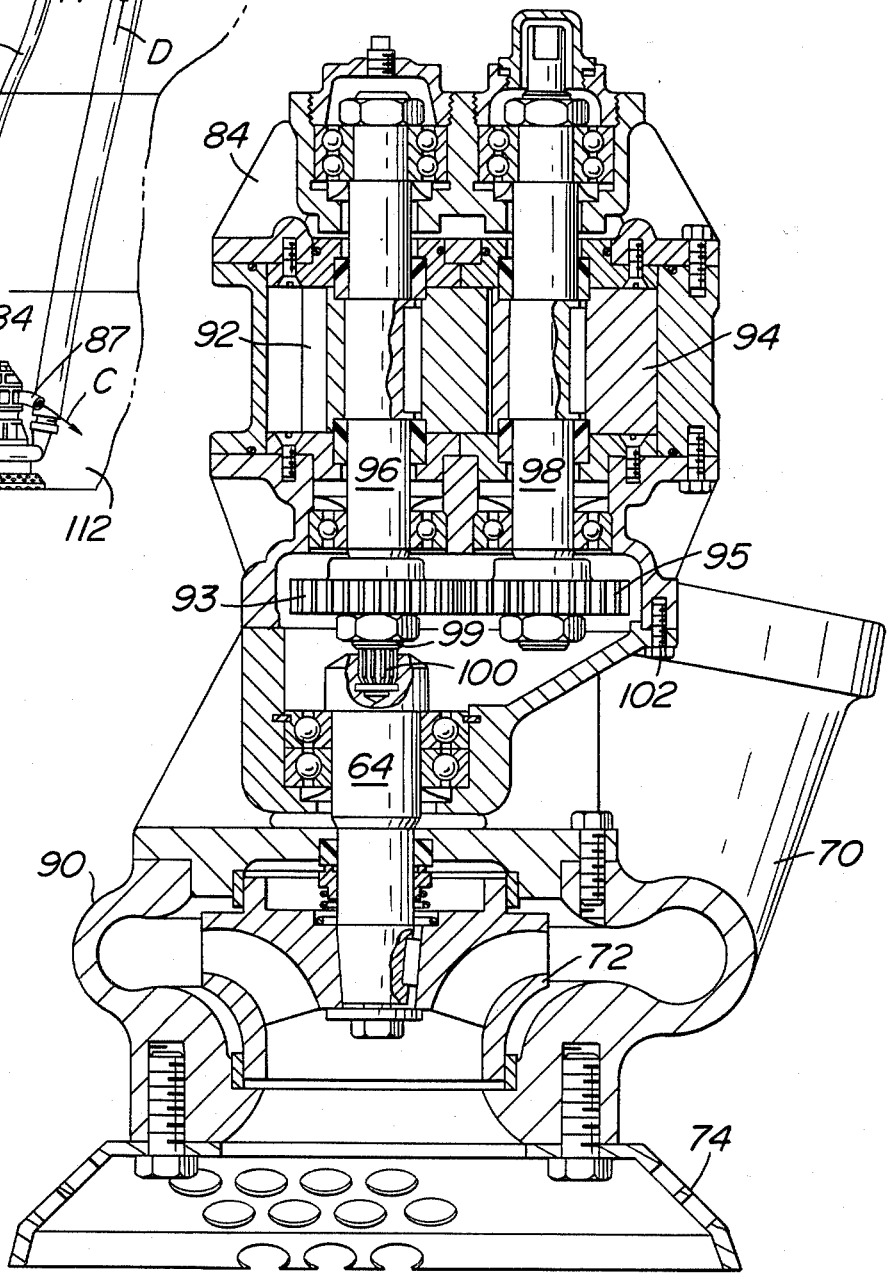
FIG. 6 is a sectional view of a submersible pump-water motor combination shown in FIGS. 4 and 5.

The pumping system shown in FIGS. 4–6 comprises a fire fighting unit with a remote dewatering setup similar to that shown in FIGS. 1–3 except that the sealed and pressurized hydraulic unit, including the hydraulic pump and hydraulic motor, is replaced by a simpler unit including a line from the fire pump discharge arranged to supply water at a low volume and high pressure to a water motor mounted on a high volume, low pressure submersible pump for driving the same. This pumping system comprises three separate components, namely, (1) an engine 80 and a standby fire pump 82, (2) a unit including a water motor 84 and a line 86 connected from the discharge of fire pump 82 to the inlet of water motor 84, and (3) a submersible pump 90.

Engine 80 and pump 82 form a unit similar to the engine 10 and pump 12 described above, with pump 82 being connected to the power takeoff shaft of engine 80 by means of a conventional quick couple-disconnect coupling 81 comprising a releasable coupling means and clamping means whereby the pump drive shaft can be quickly coupled and decoupled from the engine power takeoff shaft. Engine 80 and pump 82 are supported on a portable skid or carrying frame 24 which also supports the fuel supply for engine 80.

Pump 82 is a standby fire fighting pump and, by way of example, may be a 200 G.P.M., 150 P.S.I. centrifugal pump which can be automatically primed.

Submersible pump 90 is similar to pump 20 described above, is suitable for dewatering purposes, and is, for example, a centrifugal pump delivering 800 G.P.M. at 40 P.S.I. through its discharge 70. Pump 82 is provided with a conventional impeller 72 and inlet means 74 as provided in pump 20.

Water motor 84 is of a conventional type including a pair of positive displacement 3-lobed rotary intermeshing hydraulic motor rotors 92 and 94 synchronized by timing gears 93 and 95 mounted on rotor shafts 96 and 98, respectively, as shown in FIG. 6. The rotor shaft 96 has a shaft portion 99 extending beyond the timing gear 93 as is shown in FIG. 6. Means are provided for coupling the drive shaft 64 of submersible pump 90 to the shaft portion 99 of water motor 84 so that submersible pump 90 can be driven by water motor 84. Such coupling means comprises a spline-type of coupling 100 arranged as shown in FIG. 6 and a mounting means including bolts 102 for mounting water motor 84 on submersible pump 90 so that shaft portion 99 of water motor 84 is engaged with the drive shaft 64 of submersible pump 90.

Water motor 84 has its inlet conduit 85 connected to the downstream end of line 86 and its discharge conduit 87 open to discharge water passing through the water motor 84 at the location of the submersible pump 90 as will be described hereafter. The discharge 70 of submersible pump 90 is connected by a line 104 extending upwardly over the side of the ship as is shown in FIGS. 5 and 6 for a purpose to be described hereafter.

The pumping system shown in FIGS. 4–6 comprises a fire fighting unit with a remote dewatering means. When the pumping system is used on board ships it is set up normally as a fire fighting unit with engine 80 and pump 82 sitting on the deck 110 of the ship (FIG. 5) with the pump discharge line 86 ready to be taken to a fire location where the fire will be fought with a nozzle connected on the end of the discharge line 86. However, when, for example, it is necessary to dewater a ship that is taking on water in the hold, the pumping system is arranged in the manner shown in FIG. 5. Thus, discharge line 86 is run down to the water motor—submersible pump combination which is located down in the hold 112 to be dewatered whereat line 86 is connected to inlet conduit 85 of water motor 84 as shown. While the outlet 87 of water motor 84 directs the discharge flow into the hold 112 at this location, this presents no problem because the volume of water removal of submersible pump 90 is much higher than the amount of water delivered from the high pressure, low volume fire pump 82 through water pump 84 to drive the submersible pump 90. The line 104 connected to discharge 70 of submersible pump 90 is of a light weight plastic and is a large size so as to provide very little friction loss to the water flow. Line 104 is also preferably a thin wall plastic so that it is very portable and easy to handle.

The flow of the liquids during a dewatering operation is shown by the arrows in FIGS. 4 and 5. Thus, the fire pump 82 is supplied with water through a line which extends over the side of the ship see arrow A) and pump 82 delivers water at a low volume and high pressure to the inlet conduit 85 of water motor 84 by way of discharge line 86 (see arrow B). The water flows from inlet conduit 85 through the water motor 84 causing rotation of the rotors 92 and 94 and is discharged through outlet conduit 87 (see arrow C). The rotation of rotor 92 causes a corresponding rotation of shaft 96 and shaft extension 99 which is coupled to the drive shaft 64 of submersible pump 90 to cause rotation of impeller 72 so that water is drawn through inlet 74 and pumped at a high volume and low pressure through discharge 70 and line 104 over the side of the ship (see arrow D). In this manner, the remote dewatering unit serves to remove water from the hold of the ship.

It is noted that by reason of the construction and arrangement of the pumping system of the invention, the fire pump 82 and its driving engine 80 could be located on a ship along side the ship to be dewatered and the submersible pump—water motor combination could be located on the ship to be dewatered. By this arrangement, as in Coast Guard use, it would not be necessary to have the engine 80 running on a sinking vessel.

Another feature of the pumping system of FIGS. 4–6 is that the dewatering usage of the system, which is much more often than a fire fighting usage, serves to exercise the engine 80 and keep it in condition for the emergency use in fighting a fire.

What is claimed is:

1. A pumping system adapted to be selectably connected to operate as a fire pump or a hydraulic pump and particularly adapted for use on board ships or similar applications for fire fighting and dewatering operations comprising:

an engine having a power takeoff shaft, a standby pump having an output shaft, means connecting said standby pump to the power takeoff shaft of said engine so that said standby pump is driven by said engine such as when the pumping system is connected to operate as a fire pump, a hydraulic pump having an inlet and a discharge, means for selectably connecting said hydraulic pump to said output shaft of said standby pump so that said hydraulic pump is driven by said standby pump such as when the pumping system is connected to operate as a hydraulic pump, a hydraulic motor having an output shaft and an inlet and an outlet, hose means for providing fluid flow connections between said hydraulic pump inlet and discharge and said inlet and outlet of said hydraulic motor so that said hydraulic motor is driven by said hydraulic pump at a location remote from said standby pump, a submersible pump, means connecting said submersible pump to said output shaft of said hydraulic motor so that said submersible pump is driven by said hydraulic motor such as when the pumping system is connected for a dewatering operation, said standby pump being a centrifugal pump having an impeller and seal means for the impeller, and means for lubricating and cooling said seal means so that said centrifugal pump is adapted to be run dry.

2. A pumping system according to claim 1 wherein said centrifugal pump is provided with its own priming system.

3. A pumping system according to claim 1 wherein said means for connecting said hydraulic pump to said standby pump comprises a quick couple-disconnect type of coupling.

4. A pumping system according to claim 1 wherein said means for connecting said hydraulic motor to said submersible pump comprises a quick couple-disconnect type of coupling.

5. A pumping system according to claim 1 wherein said hydraulic motor is adapted to operate at a substantially higher displacement per revolution than said hydraulic pump.

6. A pumping system according to claim 5 wherein said submersible pump is adapted to provide sufficient pressure to raise the water pumped thereby a desired height.

7. A pumping system according to claim 1 wherein said means connecting said standby pump to said engine comprises a quick couple-disconnect type of coupling.

8. A pumping system according to claim 1 wherein said hydraulic pump, said hydraulic motor and said hose means are connected together as a sealed, pressurized hydraulic system including an accumulator.

9. A pumping system according to claim 1 wherein said hose means includes a retractable reel.

10. A pumping system according to claim including a portable carrying frame having said engine and said standby pump mounted thereon.

* * * * *